US007511207B2

(12) United States Patent
Meilleur

(10) Patent No.: US 7,511,207 B2
(45) Date of Patent: Mar. 31, 2009

(54) TWELVE PIECE SOUNDBOARD FOR STRINGED MUSICAL INSTRUMENTS

(76) Inventor: Robert Alvin Meilleur, 208 King St. W., North Bay, Ontario (CA) P1B 5Z8

( * ) Notice: Subject to any disclaimer, the term of this patent is extended or adjusted under 35 U.S.C. 154(b) by 0 days.

(21) Appl. No.: 11/327,001

(22) Filed: Jan. 6, 2006

(65) Prior Publication Data

US 2007/0157788 A1 Jul. 12, 2007

(51) Int. Cl.
*G10D 3/00* (2006.01)
*G10D 1/08* (2006.01)

(52) U.S. Cl. ..... 84/291; 84/267; 84/275

(58) Field of Classification Search ..... 84/291, 84/267, 275

See application file for complete search history.

(56) References Cited

U.S. PATENT DOCUMENTS 663,440 A * 12/1900 Isbell ..... 84/268
755,086 A * 3/1904 Voorhees ..... 84/268
1,149,059 A * 8/1915 Ingram ..... 84/275
3,277,620 A * 10/1966 Martin ..... 52/82
3,427,797 A * 2/1969 Negoro et al. ..... 368/205
3,440,919 A * 4/1969 Baker ..... 84/291
4,031,798 A * 6/1977 Sidner ..... 84/291
4,249,959 A * 2/1981 Jebens ..... 136/244
4,320,685 A * 3/1982 Pytlewski ..... 84/291
4,413,452 A * 11/1983 Wilkinson ..... 52/82
4,881,441 A * 11/1989 Larsen ..... 84/291
5,469,770 A * 11/1995 Taylor ..... 84/291
6,935,075 B2 * 8/2005 Sherman ..... 52/79.1
2007/0157788 A1 * 7/2007 Meilleur ..... 84/291

* cited by examiner

*Primary Examiner*—Walter Benson
*Assistant Examiner*—Robert W Horn

(57) ABSTRACT

A new sound board construction for the stringed musical instrument is provided. The sound board comprises 12 wedge shaped, flat wooden pieces joined at the center and along the edges between adjacent pieces. Bracing is provided behind the joints between the wedge pieces. The grain of the wood in each of the wedge pieces is arranged to extend from the joining point or apex to the outer edge of the wedge piece.

3 Claims, 3 Drawing Sheets

TWELVE PIECE SOUNDBOARD FOR STRINGED MUSICAL INSTRUMENTS

CROSS REFERENCE TO RELATED APPLICATIONS not applicable

STATEMENT REGARDING FEDERALLY SPONSORED RESEARCH OR DEVELOPMENT not applicable

THE NAMES OF THE PARTIES TO A JOINT RESEARCH AGREEMENT not applicable

INCORPORATION BY REFERENCE OF MATERIAL SUBMITTED ON COMPACT DISK not applicable

BACKGROUND OF THE INVENTION

The invention is in the field of soundboards for stringed musical instruments.

A great majority of soundboards on acoustic string instruments are made of a two matched pieces of wood, joined together and braced on the inside in an "X" configuration. This forces the vibrations in the sound to deflect in many directions.

Since the musical properties of wood is 16 times better in the direction of the grain, the inventor presents a way to eliminate cross bracing to allow the musical vibrations to travel unimpeded and un-deflected from the sound board to the rest of the instrument.

The present inventor provides a solution by using a different sound board structure.

BRIEF SUMMARY OF THE INVENTION

The unique sound board structure uses 12 triangular pieces of wood, arranged like the braces of a wheel. Vibrations travel directly and undeflected to the rest of the instrument. Each triangular piece joins the others in the middle under the central bridge and spans about 30 degrees. The twelve wedge-shaped triangular pieces are arranged concentrically to form the soundboard. The apex of each wedge terminates under the bridge, while the outer edges of the wedge are attached to the rim or sidewall of the instrument. Each wedge-shaped sound board piece is braced underneath the joints between the wedges, with bracing extending outward from the center like the spokes of a wheel. A plate the same size and shape as the bridge is placed directly under the bridge at the apex of the wedge pieces.

Since the musical properties of wood is 16 times better in the direction of the grain, the grain of the wood of each wedge piece is arranged to extend outward from the apex to the edge. This gives the sound board greater strength and better musical qualities.

DETAILED DESCRIPTION

Figure 1:
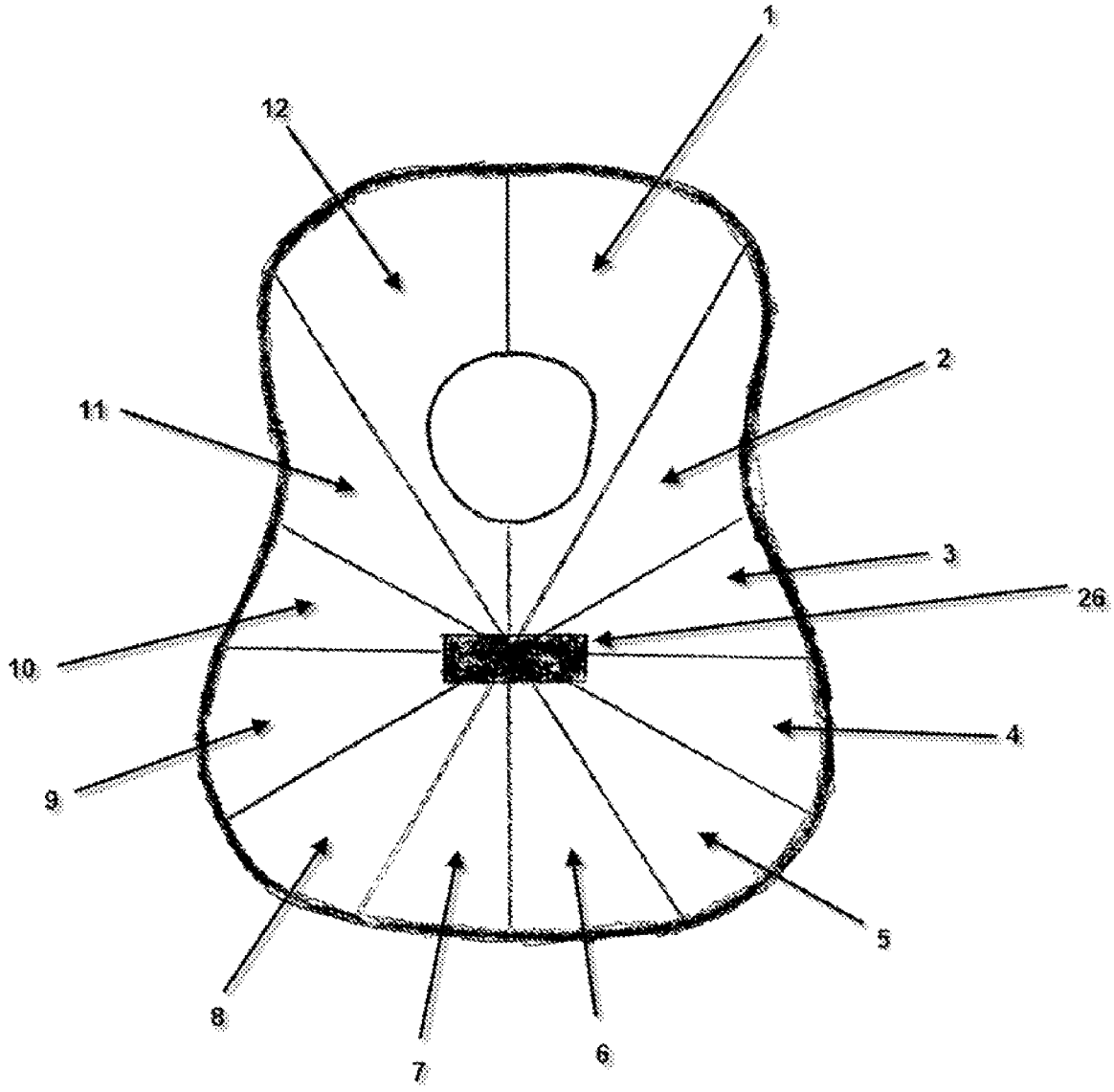
FIG. 1 is a front view of the sound board, showing wedge-shaped pieces.

The invention is a new construction of the musical instrument sound board. FIG. 1 illustrates a top view acoustic guitar sound board comprised of 12 wooden wedge-shape pieces 1-12, each extending to the instrument sidewall and joining at an apex under the bridge 1. Each wedged shape sheet of the soundboard is angled about 30 degrees at the apex.

Figure 2:
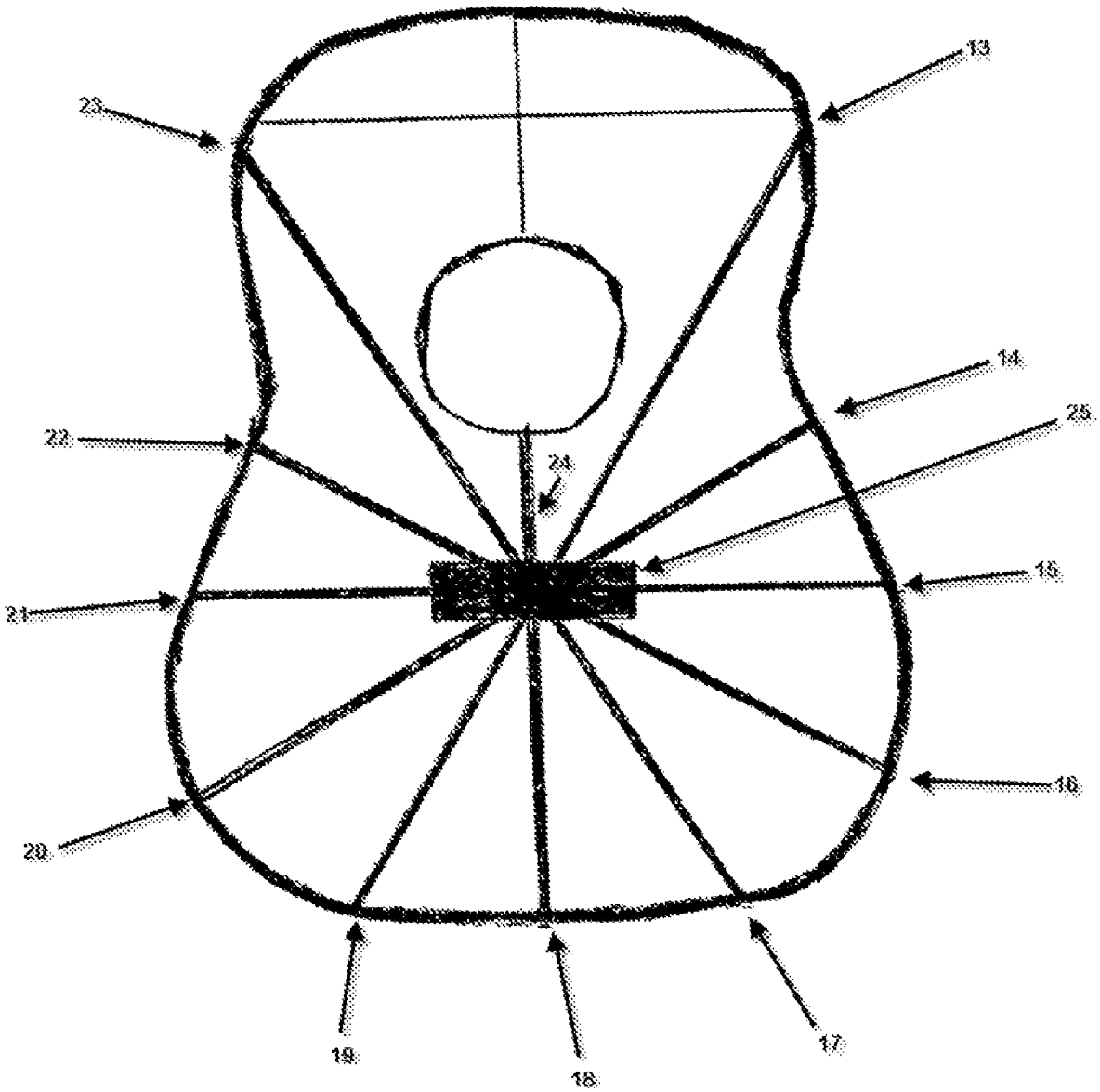
FIG. 2, is a rear view of the sound board, showing bracing pieces joining the wedge-shaped pieces.

FIG. 2 shows a bottom view of the sound board where radially extending braces 13-24 are used to join and structurally support the sound board pieces. Each of the braces joins to plate 25, at apex in the area behind the bridge, 26. The bridge pin holes are configures as to not go through the braces.

Figure 3:
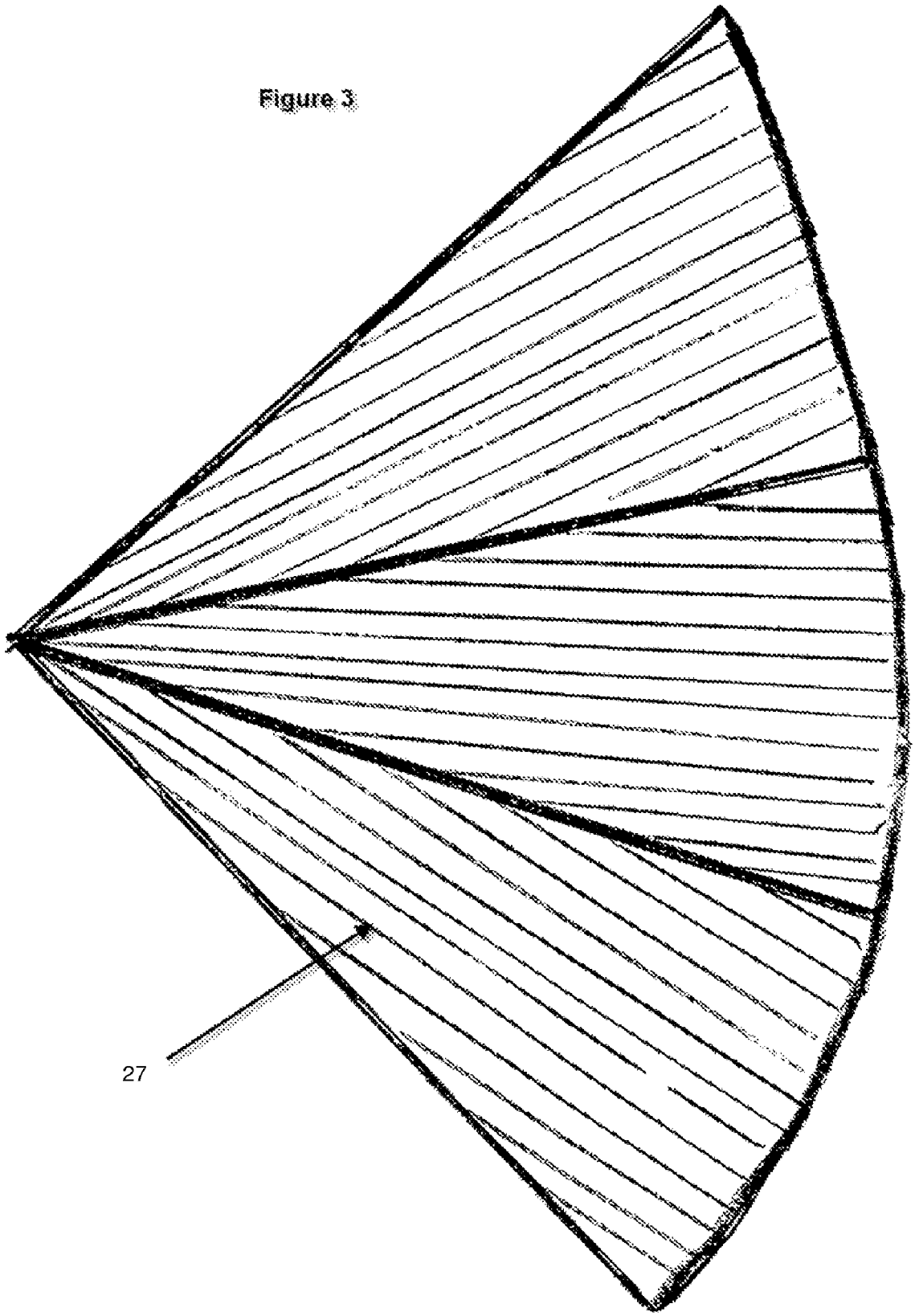
FIG. 3, shows the detail of the wood grain of each wedge-shaped piece.

The wood grain 27 of each wedge-shaped sound board is made to extend from the apex to the outer edge of each piece as shown in FIG. 3. The direction of the wood grain makes the sound board stronger and the uninterrupted sound vibrations radiate outward from the bridge along the wood grain.

I claim:

1. A new type of soundboard for stringed musical instruments, such as guitars, comprising:

twelve triangular pieces, shaped like wedges, each cut to thirty degrees;

twelve joints formed between the twelve pieces attached together to form the soundboard;

the apex of each piece terminates under the bridge;

the base of each piece comprising the wide part that is shaped and attached to the sides of the instrument;

braces under each joint on the underside of the soundboard and terminating under a plate that is attached to the braces directly under the bridge;

wherein the bridge is attached to the top of the soundboard directly over the plate and where all the top's pieces join together.

2. A soundboard, according to claim 1, wherein the braces run directly from the plate to the rims uninterrupted or undeflected without transverse bracing.

3. A soundboard, according to claim 1, wherein the braces transfer and conduct the musical vibrations uninterrupted and undeflected to the rest of the instrument and follows the grain as close as possible.

* * * * *